US010254028B2

(12) United States Patent
Lin et al.

(10) Patent No.: US 10,254,028 B2
(45) Date of Patent: Apr. 9, 2019

(54) COOLING SYSTEM WITH DIRECT EXPANSION AND PUMPED REFRIGERANT ECONOMIZATION COOLING

(71) Applicant: Liebert Corporation, Columbus, OH (US)

(72) Inventors: Zhiyong Lin, Dublin, OH (US); Steven Madara, Dublin, OH (US); Benedict J. Dolcich, Westerville, OH (US); Stephen Sillato, Westerville, OH (US); Daniel J. Schutte, Lewis Center, OH (US)

(73) Assignee: Vertiv Corporation, Columbus, OH (US)

( * ) Notice: Subject to any disclaimer, the term of this patent is extended or adjusted under 35 U.S.C. 154(b) by 176 days.

(21) Appl. No.: 15/176,559

(22) Filed: Jun. 8, 2016

(65) Prior Publication Data

US 2016/0363359 A1 Dec. 15, 2016

Related U.S. Application Data

(60) Provisional application No. 62/173,641, filed on Jun. 10, 2015.

(51) Int. Cl.
*F25B 49/02* (2006.01)
*F25B 41/04* (2006.01)
(Continued)

(52) U.S. Cl.
CPC ..... *F25B 49/02* (2013.01); *F25B 25/00* (2013.01); *F25B 41/00* (2013.01); *F25B 41/04* (2013.01);
(Continued)

(58) Field of Classification Search
CPC . F24F 2011/0006; F24F 2110/12; F25B 5/00; F25B 5/02; F25B 25/005;
(Continued)

(56) References Cited

U.S. PATENT DOCUMENTS 3,435,631 A 4/1969 Wood, Jr.
3,738,117 A 6/1973 Engel
(Continued)

FOREIGN PATENT DOCUMENTS

EP 2389056 A1 11/2011
WO WO-2008079119 A1 7/2008
WO WO-2012145263 A2 10/2012

OTHER PUBLICATIONS

Liebert DSE with EconoPhase—Highest Efficiency DX Cooling with pumped refrigerant economizer product brochure, 2015.
(Continued)

*Primary Examiner* — Jonathan Bradford
(74) *Attorney, Agent, or Firm* — Harness, Dickey & Pierce, P.L.C.

(57) ABSTRACT

A cooling system has both pumped refrigerant economization and direct expansion cooling. When outside air temperature is low enough that pumped refrigerant economization can provide enough cooling to satisfy cooling demand, only pumped refrigerant economization cooling is used to provide cooling. When outside air temperature is low enough that pumped refrigerant economization can provide some but not all of the cooling needed to satisfy cooling demand, the pumped refrigerant economization is operated at one hundred percent capacity and the direct expansion cooling is operated at a capacity to provide any supplemental cooling that is needed. If the outside air temperature is
(Continued)

high enough that pumped refrigerant economization cannot provide any cooling, then only direct expansion cooling is used to provide cooling.

8 Claims, 12 Drawing Sheets

(51) Int. Cl.
*F25B 25/00* (2006.01)
*F25B 41/00* (2006.01)

(52) U.S. Cl.
CPC .... *F25B 49/022* (2013.01); *F25B 2400/0401* (2013.01); *F25B 2400/19* (2013.01); *F25B 2500/05* (2013.01); *F25B 2600/2501* (2013.01); *F25B 2700/195* (2013.01); *F25B 2700/2106* (2013.01)

(58) Field of Classification Search
CPC ..... F25B 41/00; F25B 41/003; F25B 41/04; F25B 49/02; F25B 49/022; F25B 2400/0401; F25B 2400/19; F25B 2600/13; F25B 2600/2501; F25B 2700/2106; Y02B 30/54
See application file for complete search history.

(56) References Cited

U.S. PATENT DOCUMENTS 4,201,065 A 5/1980 Griffin
5,205,130 A 4/1993 Pannell
5,307,645 A 5/1994 Pannell
5,551,245 A 9/1996 Calton et al.
5,649,428 A 7/1997 Calton et al.
6,092,377 A 7/2000 Tso
6,553,778 B2 4/2003 Tipton et al.
6,557,372 B1 5/2003 Ozawa et al.
6,978,630 B2 12/2005 Wensink et al.
7,469,555 B2 12/2008 Taras et al.
7,654,109 B2 2/2010 Vaisman et al.
8,117,859 B2 2/2012 Chessel et al.
8,261,561 B2 9/2012 Rigal et al.
8,813,512 B2 8/2014 Rajasekaran et al.
8,881,541 B2 11/2014 Noll et al.
8,925,337 B2 1/2015 Poux et al.
2010/0023166 A1 1/2010 Chessel et al.
2010/0036530 A1 2/2010 Chessel et al.
2010/0036531 A1 2/2010 Chessel et al.
2010/0070082 A1 3/2010 Chessel et al.
2010/0107659 A1 5/2010 Hildreth, Jr.
2011/0192188 A1 8/2011 Nickey et al.
2012/0078563 A1* 3/2012 Grabinger ..... F24F 11/0001 702/104
2012/0168119 A1* 7/2012 Dunnavant ..... F24F 3/14 165/59
2012/0174612 A1* 7/2012 Madara ..... F24F 3/147 62/259.2
2013/0098085 A1 4/2013 Judge et al.
2013/0098087 A1 4/2013 Noll et al.
2013/0167577 A1 7/2013 Street et al.
2014/0033753 A1* 2/2014 Lu ..... F25B 49/02 62/190
2015/0007596 A1 1/2015 Bean, Jr. et al.
2015/0135755 A1* 5/2015 Rich ..... F28D 19/041 62/272

OTHER PUBLICATIONS

Liebert DSE Precision Cooling System product brochure, 2011.
International Search Report and Written Opinion of the International Searching Authority for PCT/US2016/036808.

* cited by examiner

| Table 1 | |
|---|---|
| Mode 1 | 312 On (PRE On)<br>302 Off (DX Off) |
| Mode 2 | 312 On (PRE On)<br>302 Off (DX On) |
| Mode 3 | 312 On (PRE Off)<br>302 Off (DX On) |

| Table 2 | | |
|---|---|---|
| Mode 1 | | |
| | Mode 1.1 | 312 On (PRE On)<br>302 Off (DX Off)<br>502 On (PRE On DX Off) |
| | Mode 1.2 | 312 On (PRE On)<br>302 Off (DX Off)<br>502 Off (PRE Off, DX Off) |
| Mode 2 | | |
| | Mode 2.1 | 312 On (PRE On)<br>302 On(DX On)<br>502 On (PRE On, DX Off) |
| | Mode 2.2 | 312 On (PRE On)<br>302 On (DX On)<br>502 Off (PRE Off, DX Off) |
| | Mode 2.3 | 312 On (PRE On)<br>302 On (DX On)<br>502 On (PRE Off, DX On) |
| Mode 3 | | |
| | Mode 3.1 | 312 Off (PRE Off)<br>302 On (DX On)<br>502 On (PRE Off, DX On) |
| | Mode 3.2 | 312 Off (PRE Of)<br>302 On (DX On)<br>502 Off (PRE Off, DX Off) |

Fig-6B

| Table 3 | | |
|---|---|---|
| Mode 1 | | |
| | Mode 1.1 | 702 On (PRE On, DX Off)<br>502 On (PRE On, DX Off) |
| | Mode 1.2 | 702 On (PRE On, DX On)<br>502 Off (PRE Off, DX Off) |
| Mode 2 | | 702 On (PRE On, DX Off)<br>502 On (PRE Off, DX On) |
| Mode 3 | | 702 On (PRE Off, DX On)<br>502 On (PRE Off, DX On) |

Fig-8B

COOLING SYSTEM WITH DIRECT EXPANSION AND PUMPED REFRIGERANT ECONOMIZATION COOLING

CROSS-REFERENCE TO RELATED APPLICATIONS

This application claims the benefit of U.S. Provisional Application No. 62/173,641 filed Jun. 10, 2015. The entire disclosure of the above application is incorporated herein by reference.

FIELD

The present disclosure relates to cooling systems, and more particularly, to high efficiency cooling systems.

BACKGROUND

This section provides background information related to the present disclosure which is not necessarily prior art.

Cooling systems have applicability in a number of different applications where fluid is to be cooled. They are used in cooling gas, such as air, and liquids, such as water. Two common examples are building HVAC (heating, ventilation, air conditioning) systems that are used for "comfort cooling," that is, to cool spaces where people are present such as offices, and data center climate control systems.

A data center is a room containing a collection of electronic equipment, such as computer servers. Data centers and the equipment contained therein typically have optimal environmental operating conditions, temperature and humidity in particular. Cooling systems used for data centers typically include climate control systems, usually implemented as part the control for the cooling system, to maintain the proper temperature and humidity in the data center.

FIG. 1 shows an example of a typical data center 100 having a climate control system 102 (also known as a cooling system). Data center 100 illustratively utilizes the "hot" and "cold" aisle approach where equipment racks 104 are arranged to create hot aisles 106 and cold aisles 108. Data center 100 is also illustratively a raised floor data center having a raised floor 110 above a sub-floor 112. The space between raised floor 110 and sub-floor 112 provides a supply air plenum 114 for conditioned supply air (sometimes referred to as "cold" air) flowing from computer room air conditioners ("CRACs") 116 of climate control system 102 up through raised floor 110 into data center 100. The conditioned supply air then flows into the fronts of equipment racks 104, through the equipment (not shown) mounted in the equipment racks where it cools the equipment, and the hot air is then exhausted out through the backs of equipment racks 104, or the tops of racks 104. In variations, the conditioned supply air flows into bottoms of the racks and is exhausted out of the backs of the racks 104 or the tops of the racks 104.

It should be understood that data center 100 may not have a raised floor 110 or plenum 114. In this case, the CRACs 116 would draw in through an air inlet (not shown) heated air from the data center, cool it, and exhaust it from an air outlet 117 shown in phantom in FIG. 1 back into the data center. The CRACs 116 may, for example, be arranged in the rows of the electronic equipment, may be disposed with their cool air supply facing respective cold aisles, or be disposed along walls of the data center.

In the example data center 100 shown in FIG. 1, data center 100 has a dropped ceiling 118 where the space between dropped ceiling 118 and ceiling 120 provides a hot air plenum 122 into which the hot air exhausted from equipment racks 104 is drawn and through which the hot air flows back to CRACs 116. A return air plenum (not shown) for each CRAC 116 couples that CRAC 116 to plenum 122.

CRACs 116 may be chilled water CRACs or direct expansion (DX) CRACs. As used herein, "DX" may sometimes be used as an abbreviation for direct expansion. CRACs 116 are coupled to a heat rejection device 124 that provides cooled liquid to CRACs 116. Heat rejection device 124 is a device that transfers heat from the return fluid from CRACs 116 to a cooler medium, such as outside ambient air. Heat rejection device 124 may include air or liquid cooled heat exchangers. Heat rejection device 124 may also be a refrigeration condenser system, in which case a refrigerant is provided to CRACs 116 and CRACs 116 may be phase change refrigerant air conditioning systems having refrigerant compressors, such as a direct expansion system. Each CRAC 116 may include a control module 125 that controls the CRAC 116.

In an aspect, CRAC 116 includes a variable capacity compressor and may for example include a variable capacity compressor for each DX cooling circuit of CRAC 116. It should be understood that CRAC 116 may, as is often the case, have multiple DX cooling circuits. In an aspect, CRAC 116 includes a capacity modulated type of compressor or a 4-step semi-hermetic compressor. CRAC 116 may also include one or more air moving units 119, such as fans or blowers. The air moving units 119 may be provided in CRACs 116 or may additionally or alternatively be provided in supply air plenum 114 as shown in phantom at 121. Air moving units 119, 121 may illustratively have variable speed drives.

A typical CRAC 200 having a typical DX cooling circuit is shown in FIG. 2. CRAC 200 has a cabinet 202 in which an evaporator 204 is disposed. Evaporator 204 may be a V-coil assembly. An air moving unit 206, such as a fan or squirrel cage blower, is also disposed in cabinet 202 and situated to draw air through evaporator 204 from an inlet (not shown) of cabinet 202, where it is cooled by evaporator 204, and direct the cooled air out of plenum 208. Evaporator 204, a compressor 210, a condenser 212 and an expansion valve 214 are coupled together in known fashion in a DX refrigeration circuit. A phase change refrigerant is circulated by compressor 210 through condenser 212, expansion valve 214, evaporator 204 and back to compressor 210. Condenser 212 may be any of a variety of types of condensers conventionally used in cooling systems, such as an air cooled condenser, a water cooled condenser, or glycol cooled condenser. It should be understood that condenser 212 is often not part of the CRAC but is located elsewhere, such as outside the building in which the CRAC is located. Compressor 210 may be any of a variety of types of compressors conventionally used in DX refrigeration systems, such as a scroll compressor. When evaporator 204 is a V-coil or A-coil assembly, it typically has a cooling slab (or slabs) on each leg of the V or A, as applicable. Each cooling slab may, for example, be in a separate cooling circuit with each cooling circuit having a separate compressor. Alternatively, the fluid circuits in each slab such as where there are two slabs and two compressor circuits, can be intermingled among the two compressor circuits. It should be understood that evaporator 204 can have configurations other than V-Coil or A-coil assemblies, such as a horizontal slab coil assembly. Evaporator 204 is typically a fin-and-tube assembly and is used to both cool and dehumidify the air passing through them.

SUMMARY

This section provides a general summary of the disclosure, and is not a comprehensive disclosure of its full scope or all of its features.

In accordance with an aspect of the present disclosure, a cooling system has a cabinet having an air inlet and an air outlet, an air moving unit disposed in the cabinet, first and second cooling circuits, and a controller configured to operate the cooling system including the cooling circuits. The first cooling circuit has an upstream evaporator coil and a downstream evaporator coil, a condenser, a compressor, a receiver tank, a liquid pump, a liquid pump bypass valve that bypasses the liquid pump when the liquid pump bypass valve is open, a compressor bypass valve that bypasses the compressor when the compressor bypass valve is open, a controlled valve coupled between the liquid pump and the upstream evaporator coil and an expansion device coupled between the liquid pump bypass valve and the downstream evaporator coil. The second cooling circuit has an evaporator coil, a condenser, and a liquid pump, a liquid pump bypass valve that bypasses the liquid pump when the liquid pump bypass valve is open, a compressor bypass valve that bypasses the compressor when the compressor bypass valve is open, and an expansion device coupled between the liquid pump bypass valve and the downstream evaporator coil. An evaporator is disposed in the cabinet that includes the upstream evaporator coil and the downstream evaporator coil of the first cooling circuit and the evaporator coil of the second cooling circuit. The upstream and downstream evaporator coils of the first cooling circuit are arranged so that air to be cooled passes across them in serial fashion, first over the upstream evaporator coil of the first cooling circuit and then over the downstream evaporator coil of the first cooling circuit. The evaporator coil of the second cooling circuit is arranged so that the air to be cooled passes over it and over the upstream and downstream evaporator coils of the first cooling circuit in serial fashion. The first and second cooling circuits each have a pumped refrigerant economization cooling mode and a direct expansion cooling mode. When any of the first and second cooling circuits are operated by the controller in the direct expansion cooling mode, the controller is configured to have the compressor of that cooling circuit on with the compressor bypass valve of that cooling circuit closed and the liquid pump of that cooling circuit off and bypassed with the liquid pump bypass valve of that cooling circuit open and when that cooling circuit is operated by the controller in the pumped refrigerant economization cooling mode, the controller is configured to have compressor of that cooling circuit off and bypassed with the compressor bypass valve of that cooling circuit open and the liquid pump of that cooling circuit on with the liquid pump bypass valve of that cooling circuit closed. When the first cooling circuit is operated by the controller in its pumped refrigerant economization cooling mode, the controller is configured to have the controlled valve coupling the liquid pump to the upstream evaporator coil open and refrigerant flows from the liquid pump through the open controlled valve to the upstream evaporator coil and also flows from the liquid pump to the downstream evaporator coil through the expansion device. When the first cooling circuit is operated by the controller in its direct expansion cooling mode, the controller is configured to have the controlled valve closed and refrigerant flows around the bypassed liquid pump of the first refrigerant circuit and only to the downstream evaporator coil through the expansion device and not to the upstream evaporator coil.

In an aspect, the cooling system has first, second and third modes of operation. The controller is configured to operate the cooling system in its first, second and third modes of operation wherein the controller is configured to operate the cooling circuits in the first mode of operation so that only pumped refrigerant economization cooling is used to provide cooling, in the second mode of operation so that both pumped refrigerant economization cooling and direct expansion cooling are used to provide cooling, and in the third mode of operation so that only direct expansion cooling is used to provide cooling. In an aspect, when the cooling system is operating in its first mode of operation the controller is configured to operate the first cooling circuit in its pumped refrigerant economization cooling mode and configured to operate the second cooling circuit in its pumped refrigerant economization cooling mode to provide any supplemental cooling that is needed when temperature of outside air is low enough that the second cooling circuit is operable to provide cooling when operating in its pumped refrigerant economization cooling mode. In an aspect, when the cooling system is operating in its second mode of operation, the controller is configured to operate the first cooling circuit in its pumped refrigerant economization cooling mode at full capacity and configured to operate the second cooling circuit in its direct expansion cooling mode at a capacity to provide any supplemental cooling that is needed. In an aspect, when the cooling system is operating in its third mode of operation, the controller is configured to operate the first and second cooling circuits in their direct expansion cooling modes.

In an aspect, the controller is configured to: operate the cooling system in its first mode of operation when a temperature of outside air is low enough that pumped refrigerant economization can provide enough cooling to satisfy cooling demand, operate the cooling system in its second mode of operation when the temperature of outside air is low enough that pumped refrigerant economization can provide cooling to satisfy only some of the cooling demand, and operate the cooling system in its third mode of operation when the temperature of outside air is high enough that pumped refrigerant economization cannot provide cooling.

In an aspect, the upstream evaporator coil is a microchannel coil and the downstream evaporator coil is a fin and tube coil.

In an aspect, when the second cooling circuit is operated by the controller in its pumped refrigerant economization cooling mode, the controller is configured to have the controlled valve of the second cooling circuit coupling the liquid pump of the second cooling circuit to the upstream evaporator coil of the second cooling circuit open and refrigerant flows from the liquid pump of the second cooling circuit through the open controlled valve of the second cooling circuit to the upstream evaporator coil of the second cooling circuit and also flows from the liquid pump of the second evaporator circuit to the downstream evaporator coil of the second cooling circuit through the expansion device of the second cooling circuit. When the second cooling circuit is operated by the controller in its direct expansion cooling mode, the controller is configured to have the controlled valve of the second cooling circuit closed and refrigerant flows around the bypassed liquid pump of the second refrigerant circuit and only to the downstream evaporator coil of the second cooling circuit through the expansion device of the second cooling circuit and not to the upstream evaporator coil of the second cooling circuit.

A second cooling system in accordance with an aspect of the present disclosure has a cabinet having an air inlet and an air outlet, an air moving unit disposed in the cabinet, a pumped refrigerant economization cooling circuit and a direct expansion cooling circuit, and a controller configured to operate the cooling system including the cooling circuits. The pumped refrigerant economization cooling circuit has an evaporator coil, a condenser coil and a liquid pump. The direct expansion cooling circuit has an evaporator coil, a condenser coil, a compressor and an expansion device. A condenser has the condenser coil of the pumped refrigerant cooling circuit and the condenser coil of the direct expansion cooling circuit arranged so that air drawn over the condenser coils by a fan of the condenser passes over the condenser coils in serial fashion. An evaporator disposed in the cabinet includes the evaporator coil of the pumped refrigerant cooling circuit and the evaporator coil of the direct expansion cooling circuit. The evaporator coils are arranged in the cabinet so that air to be cooled passes across them in serial fashion.

In an aspect, the evaporator coil of the pumped refrigerant economization circuit is a microchannel coil and the condenser coils of the pumped refrigerant economization circuit and of the direct expansion circuit are microchannel coils and the condenser coils are arranged in the condenser so that the air passing across them in serial fashion first passes across the condenser coil of the pumped refrigerant economization circuit and then across the condenser coil of the direct expansion circuit. In an aspect, the evaporator coil of the direct expansion cooling circuit is a fin-and-tube coil.

In an aspect, the second cooling system has three modes of operation. The controller is configured to operate the cooling system in its first, second and third modes of operation wherein the controller is configured to operate the cooling circuits in the first mode of operation where only the pumped refrigerant economization circuit is operated to provide cooling, in the second mode of operation where the pumped refrigerant economization circuit is operated at one hundred percent capacity to provide cooling and the direct expansion circuit is operated at a capacity to provide any supplemental cooling that is needed, and in the third mode of operation where only the direct expansion circuit is operated to provide cooling. In an aspect the controller is configured to operate the cooling system in the first mode of operation when an outside temperature is low enough that pumped refrigerant economization can provide enough cooling to satisfy cooling demand, in the second mode of operation when the temperature of outside air is low enough that pumped refrigerant economization can provide cooling to satisfy only some of the cooling demand; and in the third mode of operation when the temperature of outside air is high enough that pumped refrigerant economization cannot provide cooling.

In an alternative aspect, the pumped refrigerant economization circuit of the second cooling system includes a second condenser coil, the second condenser coil included in a second condenser. In an aspect, the second cooling system includes a receiver tank disposed between outlets of the condenser coils of the pumped refrigerant economization circuit and an inlet of the liquid pump.

In an alternative aspect, the second cooling system further includes at least a second pumped refrigerant economization circuit that includes the liquid pump, the condenser coil and a separate evaporator coil that's included in a second evaporator disposed in a second cabinet and also a second direct expansion circuit. The second direct expansion circuit has its own evaporator coil, its own condenser coil, its own compressor and its own expansion device. The second evaporator includes the evaporator coil of the second direct expansion circuit, the evaporator coil of the second pumped refrigerant economization circuit and the evaporator coil of the second direct expansion circuit arranged in the second cabinet so that air to be cooled flows across them in serial fashion. In an aspect, the second cooling system further includes a receiver tank disposed between an outlet of the condenser coil of the pumped refrigerant economization circuit and an inlet of the liquid pump.

A third cooling system in accordance with an aspect of the present disclosure has a cabinet having an air inlet and an air outlet, an air moving unit disposed in the cabinet, a first cooling circuit that is a direct expansion cooling circuit having only a direct expansion cooling mode, a second cooling circuit that a pumped refrigerant economization cooling circuit having only a pumped refrigerant economization cooling mode, and a third cooling circuit having both a pumped refrigerant economization cooling mode and a direct expansion cooling mode, and a controller configured to operate the cooling system including the cooling circuits. The first cooling circuit has an evaporator coil, a condenser coil, a compressor and an expansion device. The second cooling circuit has an evaporator coil, a condenser coil and a liquid pump. The third cooling circuit has an evaporator coil, a condenser, a compressor, a receiver tank, a liquid pump, a liquid pump bypass valve that bypasses the liquid pump when the liquid pump bypass valve is open, a compressor bypass valve that bypasses the compressor when the compressor bypass valve is open, and an expansion device coupled between the liquid pump bypass valve and the evaporator coil of the third cooling circuit. An evaporator is disposed in the cabinet that includes the evaporator coils of the first, second and third cooling circuits with these evaporator coils arranged so air to be cooled passes across them in serial fashion. A first condenser includes the condenser coils of the first and second cooling circuits arranged so that cooling air passes across them in serial fashion and a second condenser that includes the condenser coil of the third cooling circuit. When the third cooling circuit is operated by the controller in its direct expansion cooling mode, the controller is configured to have the compressor of the third cooling circuit on with the compressor bypass valve closed and the liquid pump of the third cooling circuit is off and bypassed with the liquid pump bypass valve open. When the third cooling circuit is operated by the controller in its pumped refrigerant economization cooling mode, the controller is configured to have the compressor of the third cooling circuit off and bypassed with the compressor bypass valve open and the liquid pump of the third cooling circuit on with the liquid pump bypass valve closed.

In an aspect, the evaporator coils of the first, second and third cooling circuits of the third cooling system are arranged so that air to be cooled passing across them in serial fashion passes first across the evaporator coil of the second cooling circuit, then across the evaporator coil of the third cooling circuit and then across the evaporator coil of the first cooling circuit.

In an aspect, the evaporator coil of the second cooling circuit of the third cooling system is a microchannel coil and the evaporator coils of the second and third cooling circuits of the third cooling system are fin-and-tube coils.

In an aspect, the condenser coils of the first and second cooling circuits of the third cooling system are arranged so that cooling air passes across them in serial fashion first over the condenser coil of the second cooling circuit and then over the condenser coil of the first cooling circuit.

In an aspect, the third cooling system has three modes of operation. The controller is configured to operate the cooling system in its first, second and third modes of operation wherein the controller is configured to operate the cooling circuits in the first mode of operation where the cooling circuits are operated so that only pumped refrigerant economization cooling is used to provide cooling, in the second mode of operation where the cooling circuits are operated so that both pumped refrigerant economization cooling and direct expansion cooling are used to provide cooling, and in the third mode of operation where the cooling circuits are operated so that only direct expansion cooling is used to provide cooling. In an aspect, the second mode of operation includes three sub-modes of operation. The controller is configured to operate the cooling circuits in the three sub-modes of operation. The controller is configured to operate the cooling circuits in the first sub-mode of operation where the second cooling circuit is operated at one hundred percent capacity, the third cooling circuit is operated in its pumped refrigerant economization cooling mode at one hundred percent capacity and the first cooling circuit is operated at a capacity to provide any supplemental cooling that is needed. The controller is configured to operate the cooling circuits in the second sub-mode of operation where the second cooling circuit is operated at one hundred percent capacity, the third cooling circuit is off and the first cooling circuit is operated to provide the supplemental cooling that is needed. The controller is configured to operate the cooling circuits in the third sub-mode of operation where the second cooling circuit is operated at one hundred percent capacity, and one or both the first and third cooling circuits are operated in their direct expansion cooling modes at a collective capacity to provide any supplemental cooling that is needed.

In an aspect, when the third cooling system is operated in the third sub-mode of operation, the controller is configured to operate one of the first and third cooling circuits in its direct expansion cooling mode up to a capacity of one hundred percent to provide cooling to meet any supplemental cooling that is needed and once that one of the first and third cooling circuits reaches one hundred percent capacity, the other of the first and third circuits is then operated by the controller in its direct expansion cooling mode at a capacity to provide any additional cooling that is needed to meet the supplemental cooling that is needed.

In an aspect, when the cooling system is operated in the third sub-mode, the controller is configured to operate the first and third cooling circuits in their direct expansion cooling modes at equal capacities to meet any supplemental cooling that is needed.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 6B is an associated state table showing the same;

FIG. 8B is an associated state table showing the same.

Corresponding reference numerals indicate corresponding parts throughout the several views of the drawings.

DETAILED DESCRIPTION

Example embodiments will now be described more fully with reference to the accompanying drawings.

Figure 1:
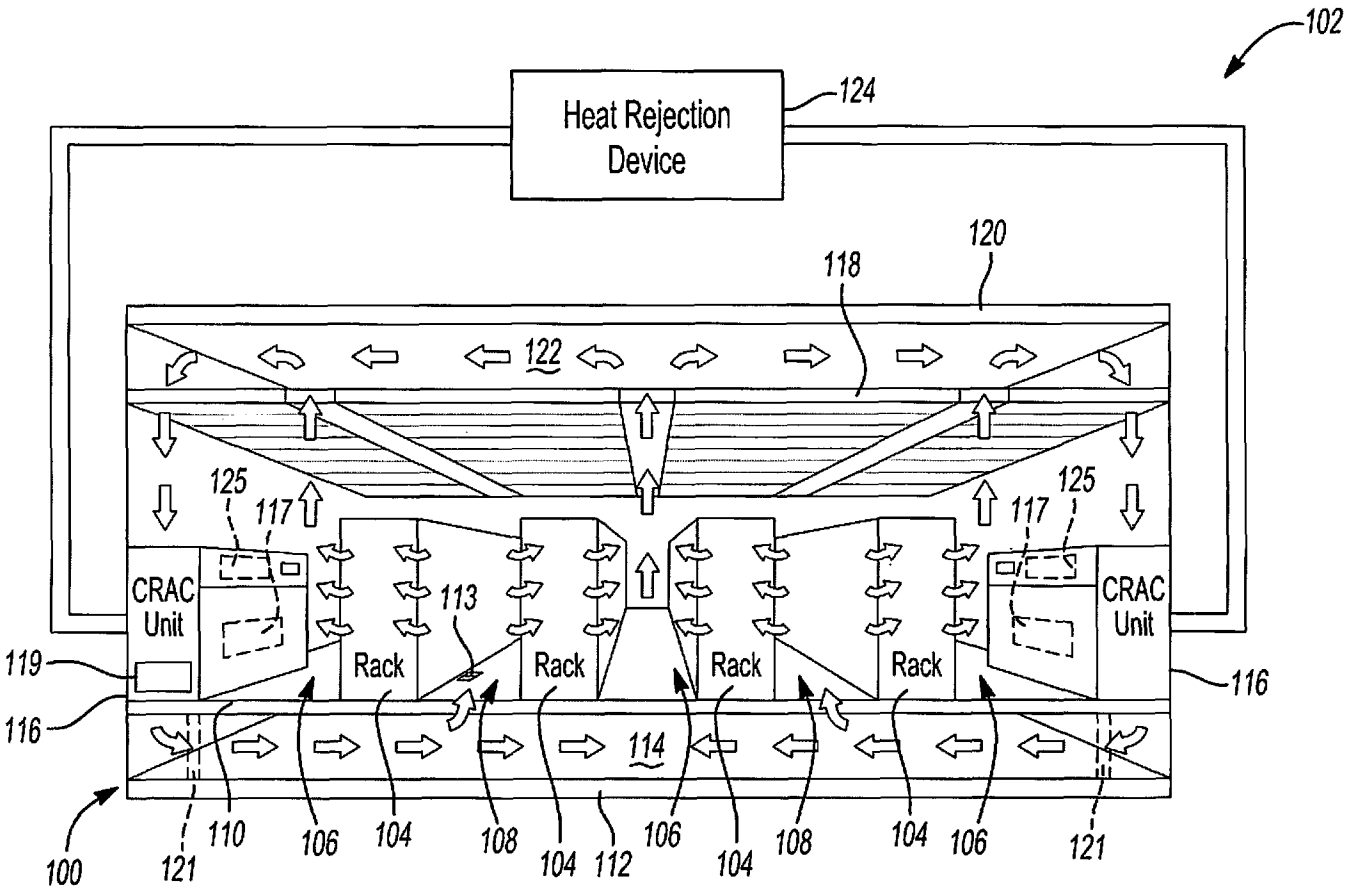
Fig-1 PRIOR ART
FIG. 1 is a schematic illustrating a prior art data center.
Figure 2:
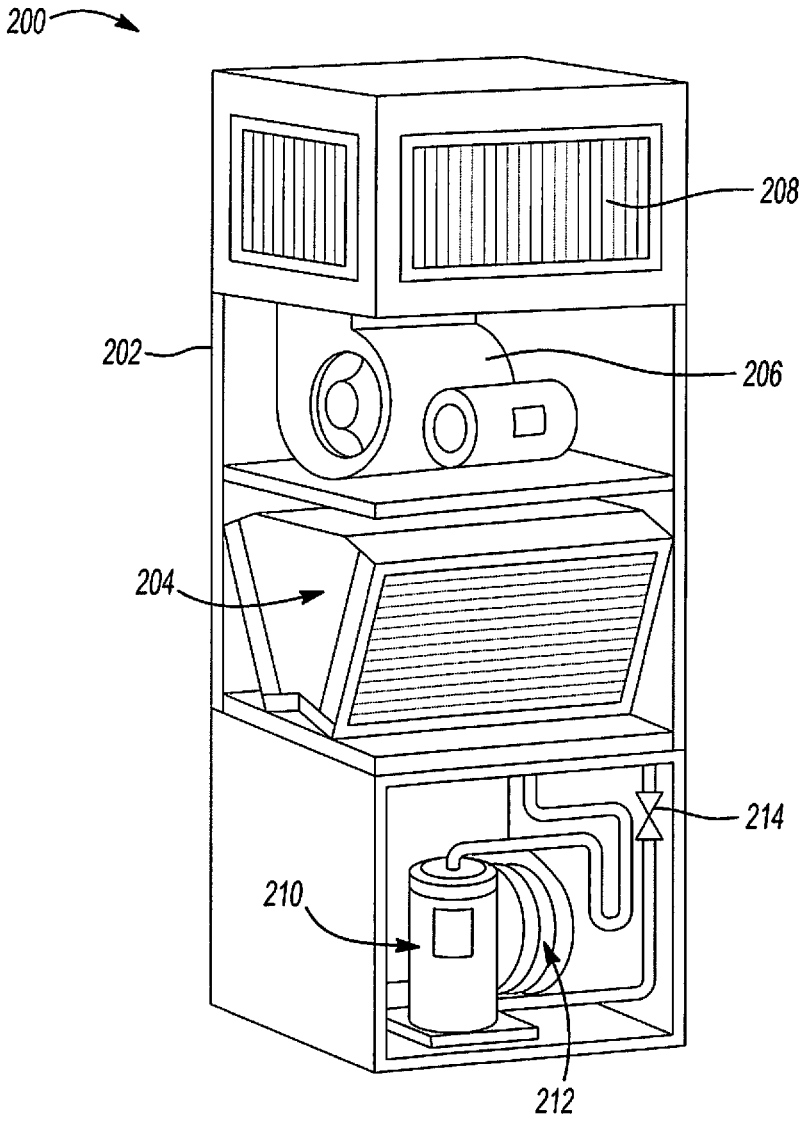
Fig-2 PRIOR ART
FIG. 2 is a simplified perspective view of a prior art CRAC having a DX cooling circuit.
Figure 3:
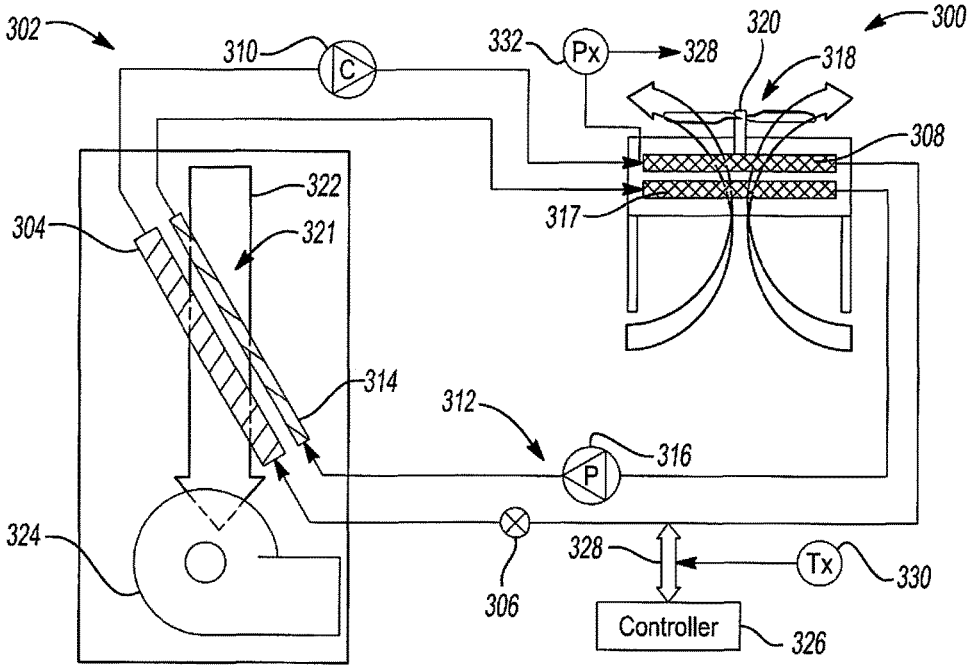
FIG. 3 is a simplified schematic of a cooling system having a pumped refrigerant economization cooling circuit and a DX cooling circuit.

With reference to FIG. 3, an embodiment of a cooling system 300 in accordance with an aspect of the present disclosure is shown. Cooling system 300 includes DX cooling and pumped refrigerant economization cooling. More specifically, cooling system 300 includes a DX cooling circuit 302 having only a DX cooling mode. DX cooling circuit 302 has an evaporator coil 304, a compressor 310, a condenser coil 308 and an expansion device 306 (which may preferably be an electronic expansion valve but may also be a thermostatic expansion valve or other type of expansion device) arranged in a DX refrigeration circuit. Cooling system 300 also includes a pumped refrigerant economization cooling circuit 312 having only a pumped refrigerant economization cooling mode. Cooling circuit 312 has an evaporator coil 314, a condenser coil 317 and a liquid pump 316 arranged in a pumped refrigerant economization cooling circuit. In the embodiment of FIG. 3, DX cooling circuit 302 and pumped refrigerant economization cooling circuit 312 are separate cooling circuits which in this context mean that the refrigerant flow paths of the cooling circuits are separate from each other and DX cooling circuit 302 and pumped refrigerant economization cooling circuit 312 can operate separately or together.

Cooling system 300 further includes a condenser 318 that includes condenser coil 317 of pumped refrigerant economization circuit 312 and condenser coil 308 of DX cooling circuit 302. Condenser 318 also has a condenser fan 320 that draws cooling air across condenser coils 308, 317. Condenser coils 308, 317 are stacked together in series in condenser 318 so that cooling air passes across them in serial fashion, first across condenser coil 317 and then across condenser coil 308. Condenser coil 317 of pumped refrigerant economization cooling circuit 312 is thus an upstream condenser coil and may be referred to herein as upstream condenser coil 317 and condenser coil 308 of DX cooling circuit 302 is a downstream condenser coil and may be referred to herein as downstream condenser coil 308. In an aspect, downstream condenser coil 308 is a microchannel cooling coil although it should be understood that it could alternatively be a fin-and-tube cooling coil or other type of fluid-to-fluid heat exchanger. In an aspect, upstream condenser coil 317 is a microchannel cooling coil although it should be understood that it could alternatively be a fin-and-tube cooling coil or other type of fluid-to-fluid heat exchanger.

Cooling system 300 also includes an evaporator 321 that includes evaporator coil 314 of pumped refrigerant economization circuit 312 and evaporator coil 304 of DX cooling circuit 302. Evaporator 321 is arranged in a cabinet 322 that also includes an air moving unit 324, such as a squirrel cage blower, that draws air to be cooled across evaporator coils 304, 314. Evaporator coils 304, 314 are stacked together in series in evaporator 321 so that air to be cooled passes across them in serial fashion, first across evaporator coil 314 and then across evaporator coil 304. Evaporator coil 314 is thus an upstream evaporator coil and may be referred to herein as upstream evaporator coil 314 and evaporator coil 304 is a downstream evaporator coil and may be referred to herein as downstream evaporator coil 304. In an aspect, upstream evaporator coil 314 is a microchannel cooling coil although it should be understood that it could alternatively be a fin-and-tube cooling coil or other type of fluid-to-fluid heat exchanger and downstream evaporator coil 304 is a fin-and-tube cooling coil although it should be understood that it could alternatively be a microchannel cooling coil or other type of fluid-to-fluid heat exchanger.

Cooling system 300 also includes a controller 326 that is configured to control cooling system 300 including cooling circuits 302 and 312. Controller 326 includes inputs/outputs 328 coupled to the various components of cooling circuits 302, 312 and to various sensors, such as an outdoor temperature sensor 330 and a pressure sensor 332 disposed to sense pressure in condenser coil 308.

Figures 4A, 4B:
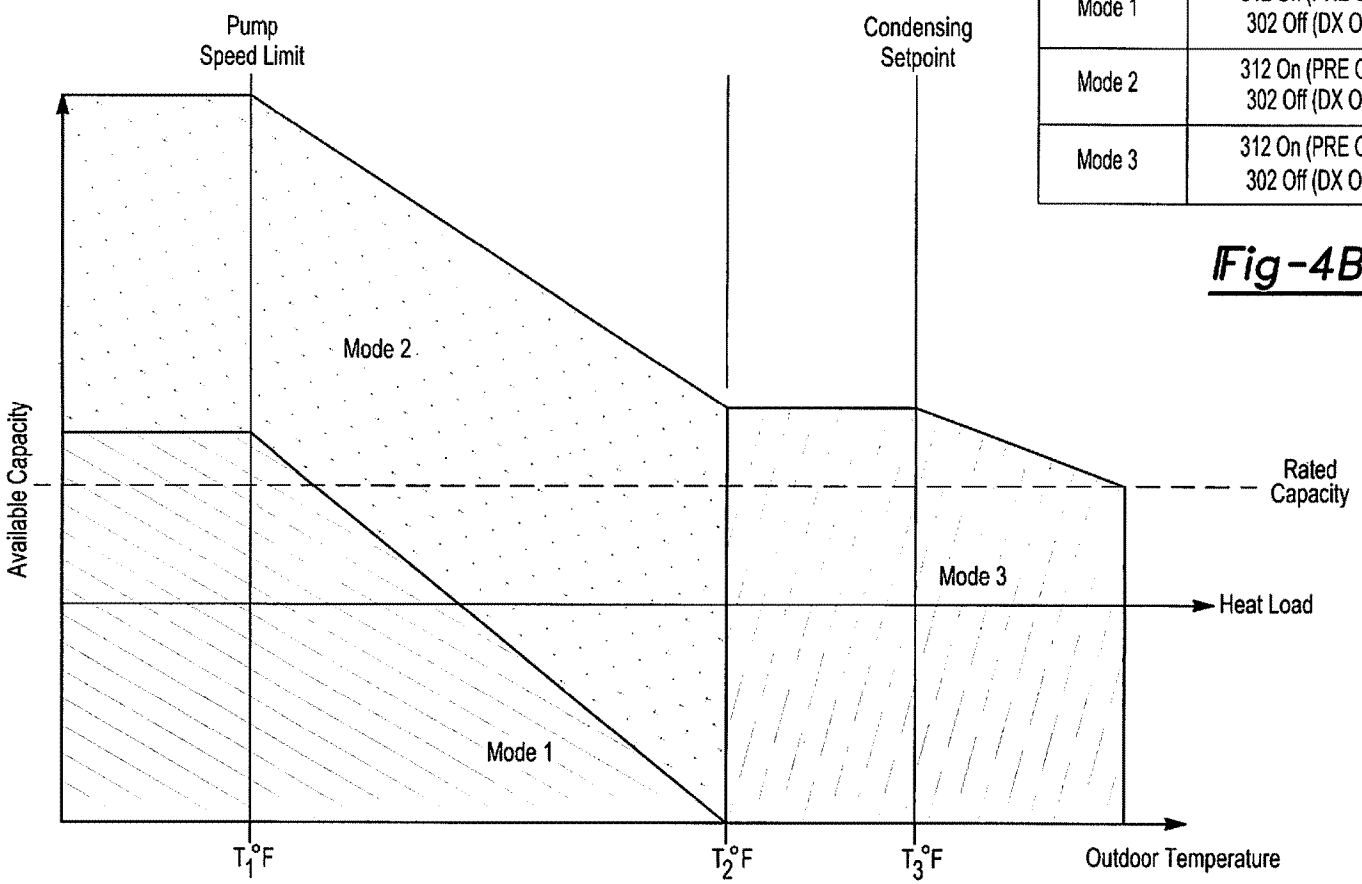
FIG. 4A is a state chart showing the operation of the cooling system of FIG. 3
FIG. 4B is an associated state table showing the same.

FIG. 4A is a state chart showing the modes of operation of cooling system 300 and Table 1 shown in FIG. 4B is a state table showing the three modes of operation of cooling system 300. As used in Table 1, as well as in Tables 2 and 3 below, "PRE" means pumped refrigerant economization and DX means direct expansion. Cooling system 300 has three basic modes of operation: a first mode (Mode 1 in FIG. 4) where only pumped refrigerant economization cooling is used to provide cooling: a second mode (Mode 2 in FIG. 4) where both pumped refrigerant economization cooling and DX cooling are used to provide cooling; and a third mode (Mode 3 in FIG. 4) where only DX cooling is used to provide cooling. As can be seen in FIG. 4A by the Heat Load line, for a given heat load cooling system 300 will change among its modes of operation depending on outdoor air temperature, as discussed in more detail below to provide enough cooling to satisfy the cooling demand due to the heat load.

With reference to FIGS. 4A and 4B, controller 326 is configured to operate cooling system 300 in the first mode of operation (Mode 1 in FIGS. 4A and 4B) where only the pumped refrigerant economization circuit 312 is operated to provide cooling when the outdoor temperature is at a low temperature which as used herein is a temperature that is at or lower than a temperature that is low enough that the pumped refrigerant economization circuit can provide enough cooling to satisfy all the cooling demand. This temperature may for example be determined heuristically or mathematically and programmed in controller 326. As used herein, unless the context dictates otherwise, the cooling demand is the cooling that cooling system 300 is called upon to provide to cool the environment, such as a data center, that cooling system 300 cools. In the first mode of operation, controller 326 is configured to operate only pumped refrigerant economization circuit 312 to provide cooling and to operate it at a capacity (0-100%) that provides enough cooling to satisfy the cooling demand. In the first mode of operation, controller 326 is configured so that it does not operate DX cooling circuit 302 to provide cooling, that is, it has compressor 310 off.

Controller 326 is configured to operate cooling system 300 in the second mode of operation (Mode 2 in FIGS. 4A and 4B) when the outdoor temperature is at a medium temperature which as used herein is a temperature in a temperature range that is low enough that pumped refrigerant economization circuit 312 can provide some cooling but is not low enough that the pumped refrigerant economization circuit 312 can provide enough cooling to satisfy all the cooling demand. It should be understood that the low and medium temperatures ranges can overlap, as shown in FIG. 4A, with the difference between whether the cooling system 300 is operating in the first mode or second mode being the cooling demand. If a particular outdoor temperature is low enough that pumped refrigerant economization can provide enough cooling to satisfy all the cooling demand, then the cooling system 300 operates in the first mode. If that particular outdoor temperature is not low enough that pumped refrigerant economization cannot provide enough cooling to satisfy all the cooling demand but pumped refrigerant economization can provide some of the cooling, the cooling system 300 operates in the second mode.

This temperature range may for example be determined heuristically or mathematically and programmed in controller 326. In the second mode of operation, controller 326 is configured to operate pumped refrigerant economization circuit 312 at 100% capacity and configured to operate DX cooling circuit 302 (running compressor 310) at a capacity (0-100%) that provides that supplemental cooling to supplement the cooling provided by the pumped refrigerant economization circuit 312 so that together the pumped refrigerant economization cooling provided by pumped refrigerant economization circuit 312 and the DX cooling provided by DX cooling circuit 302 provide enough cooling to satisfy the cooling demand. In the second mode of operation, controller 326 is configured to control condenser fan 320 to compressor cycle condensing pressure. As is known, controlling a condenser fan to compressor cycle condensing pressure is modulating the speed of the condenser fan to keep the pressure in the condenser coil at or above a setpoint.

Controller 326 is configured to operate cooling system 300 in the third mode of operation (Mode 3 in FIGS. 4A and 4B) when the outdoor temperature is at a high temperature which as used herein is a temperature that is at or above a temperature that is high enough that pumped refrigerant economization circuit 312 cannot effectively provide any cooling. This temperature may for example be determined heuristically or mathematically and programmed in controller 326. In the third mode of operation, controller 326 is configured to operate only DX cooling circuit 302 to provide cooling (running compressor 310) and to operate it at a capacity (0-100%) that provides enough cooling to satisfy the cooling demand. In the third mode of operation, controller 326 is configured to control condenser fan 320 to compressor cycle condensing pressure. In the third mode of operation, controller 326 is configured so that it does not operate pumped refrigerant economization circuit 312 to provide cooling, that is, it has pump 316 off.

Figure 5:
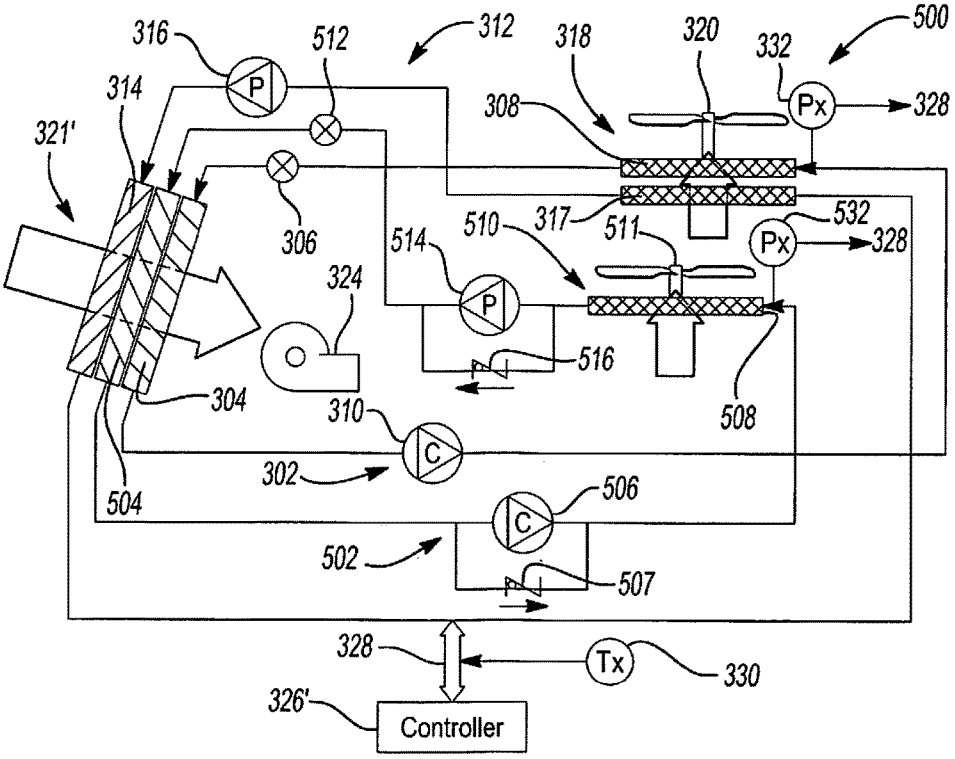
FIG. 5 is a simplified schematic of a cooling system having a pumped refrigerant economization cooling circuit and a cooling circuit having a pumped refrigerant economization cooling and DX cooling.

With reference to FIG. 5, a cooling system 500 in accordance with an aspect of the present disclosure is shown that is a variation of cooling system 300 of FIG. 3. Cooling system 500 also includes DX cooling and pumped refrigerant economization cooling. Cooling system 500 includes DX cooling circuit 302 having only a DX cooling mode, pumped refrigerant economization circuit 312 having only a pumped refrigerant economization cooling mode, and a cooling circuit 502 that has both a pumped refrigerant economization cooling mode and a DX cooling mode. Cooling circuits 302, 312 and 502 are all separate cooling circuits. Cooling circuit 502 includes an evaporator coil 504 having an outlet coupled to an inlet of a compressor 506. A bypass valve 507 is coupled around compressor 506 between the inlet of compressor 506 and an outlet of compressor 506. Bypass valve 507 is a check valve in the embodiment of FIG. 5 but it should be understood that it could be other types of valves, such as a solenoid valve. Bypass valve 507 is open when compressor 506 is off and closed when compressor 506 is running. The outlet of compressor 506 is coupled to an inlet of a condenser coil 508 of a condenser 510 that also includes a condenser fan 511.

An outlet of condenser coil 508 is coupled to an inlet of a liquid pump 514. A bypass valve 516 is coupled around liquid pump 514 between the inlet of liquid pump 514 and the outlet of liquid pump 514. Bypass valve 516 is a check valve in the embodiment of FIG. 5 but it should be understood that it could be other types of valves, such as a solenoid valve. Bypass valve 516 is open when liquid pump 514 is off and closed when liquid pump 514 is running. The outlet of liquid pump 514 is coupled through an expansion device 512 to an inlet of evaporator coil 504. Expansion device 512 may preferably be an electronic expansion valve but could be other types of expansion devices. It should be understood that condenser 510 is separate from condenser 318.

Evaporator 321' includes evaporator coil 504 of cooling circuit 502 as well as evaporator coils 304, 314. Evaporator coils 304, 504, 314 are stacked together in series in evaporator 321' so that air to be cooled passes across them in serial fashion, first across evaporator coil 314, then across evaporator coil 504 and then across evaporator coil 304. Evaporator coil 314 is thus again an upstream evaporator coil and may be referred to herein as upstream evaporator coil 314, evaporator coil 304 is again a downstream evaporator coil and may be referred to herein as downstream evaporator coil 304 and evaporator coil 504 is a mid-stream evaporator coil and may be referred to herein as midstream evaporator coil 504. In an aspect, upstream evaporator coil 314 is a microchannel cooling coil and downstream evaporator coil 304 is a fin-and-tube cooling coil. It should be understood that evaporator coil 314 could alternatively be a fin-and-tube cooling coil and evaporator coil 304 could alternatively be a microchannel cooling coil. It should be understood that evaporator coils 304, 314 could be types of fluid-to-fluid heat exchangers other than fin-and-tube cooling coils or microchannel cooling coils. In an aspect, evaporator coil 504 is a fin-and-tube cooling coil but could alternatively be a microchannel cooling coil or other type of fluid-to-fluid heat exchanger.

Cooling system 500 also includes a controller 326' that is configured to control cooling system 500 including cooling circuits 302, 312 and 502. Controller 326' includes inputs/outputs 328 coupled to the various components of cooling circuits 302, 312, 502 and to various sensors, such as an outdoor temperature sensor 330, pressure sensor 332 and pressure sensor 532 disposed to sense pressure in condenser coil 508.

Figure 6A:
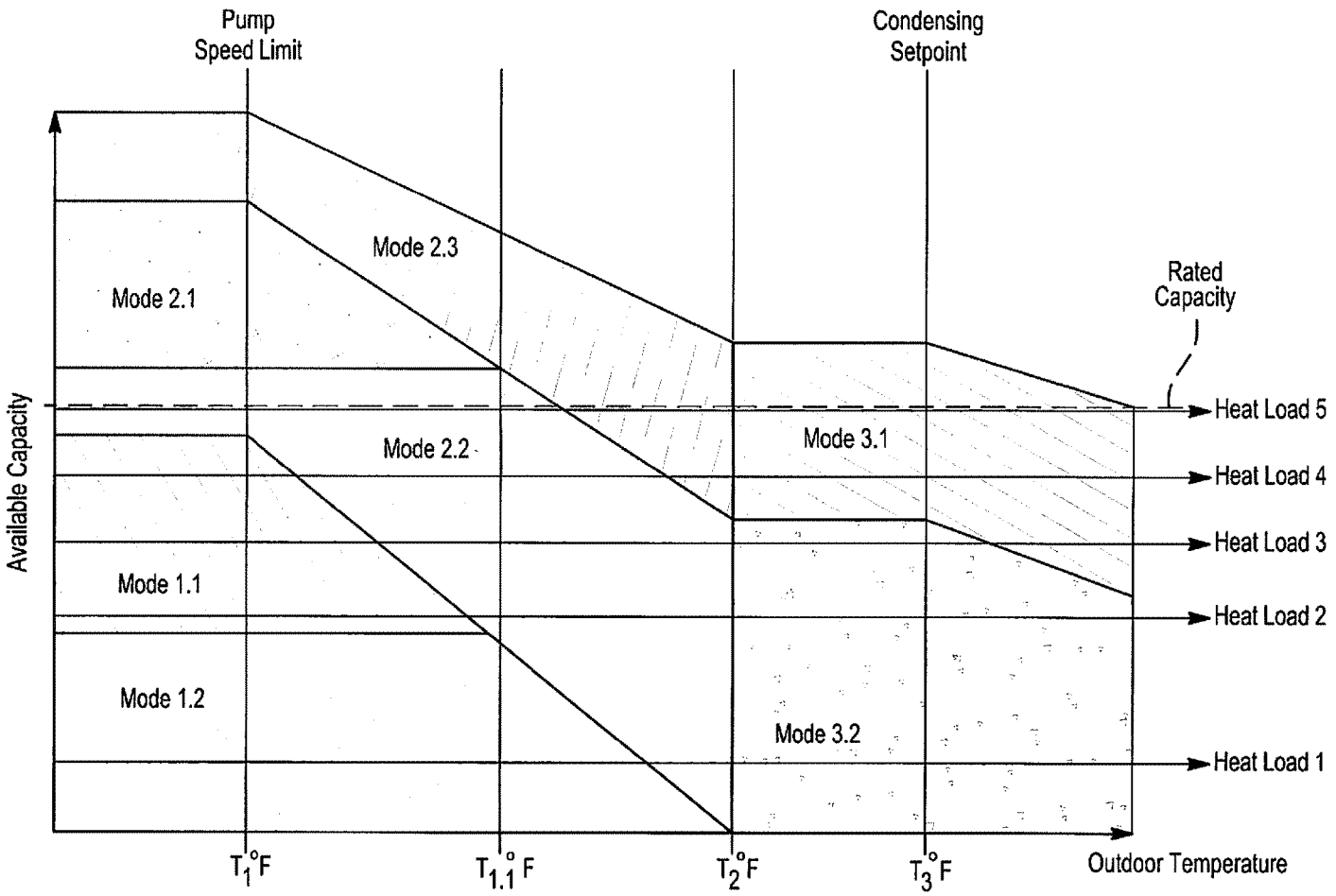
FIG. 6A is a state chart showing the operation of the cooling system of FIG. 5

FIG. 6A is a state chart showing the modes of operation of cooling system 500 and Table 2 shown in FIG. 6B is a state table showing the modes of operation of cooling system 500. Cooling system 500 has the same three basic modes of operation as cooling system 300: a first mode (Mode 1 in FIG. 6) where the cooling circuits 302, 312 and 502 are operated so that only pumped refrigerant economization cooling is used to provide cooling; a second mode (Mode 2 in FIG. 6) where cooling circuits 302, 312, 502 are operated so that both pumped refrigerant economization cooling and DX cooling are used to provide cooling; and a third mode (Mode 3 in FIG. 6) where cooling circuits 302, 312, 502 are operated so that only DX cooling is used to provide cooling. Cooling system 500 also has two sub-modes of operation when operating in Mode 1, three sub-modes of operation when operating in Mode 2, and two sub-modes of operation when operating in Mode 3, as discussed below. As can be seen in FIG. 6A by the various Heat Load lines, for any given heat load, cooling system 500 will change among its modes of operation depending on outdoor air temperature, as discussed in more detail below, to provide enough cooling to satisfy the cooling demand due to the heat load. It should be understood that Mode 1 (FIG. 6B) is defined by Modes 1.1 and 1.2 in FIG. 6A, Mode 2 (FIG. 6B) is defined by Modes 2.1, 2.1 and 2.3 in FIG. 6A and Mode 3 (FIG. 6B) is defined by Modes 3.1 and 3.2 in FIG. 6A.

With reference to FIG. 6A and Table 2 shown in FIG. 6B, controller 326' is configured to operate cooling system 500 in the first mode of operation where only pumped refrigerant economization cooling is used to provide cooling when the outdoor temperature is at a low temperature which as used herein is a temperature that is at or lower than a temperature that is low enough that pumped refrigerant economization cooling can provide enough cooling to satisfy the cooling demand. In this first mode of operation, controller 326' is configured to control the pumped refrigerant economization circuit 312 to provide cooling and also configured to control cooling circuit 502 to operate in a pumped refrigerant economization cooling mode with liquid pump 514 on with bypass valve 516 closed and compressor 506 off with bypass valve 507 open. When operating cooling circuit 502 in the pumped refrigerant economization cooling mode, controller 326" is also configured to control expansion device 512 based on pump head pressure to be mostly open so that it is acting as a pressure regulating valve to pass refrigerant through and not acting as an expansion device. In this mode of operation, controller 326' is also configured so that it does not operate DX cooling circuit 302 to provide cooling, that is, it has compressor 310 off, and also configured so that it does not operate cooling circuit 502 to provide DX cooling, that is, it has compressor 506 off.

In an aspect, in the first mode of operation cooling system 500 has two sub-modes of operation, Modes 1.1 and 1.2 in FIG. 6A and Table 2 (FIG. 6B). Controller 326' is configured to operate cooling system 500 in Mode 1.1 when the cooling demand due to heat load is high enough that both cooling circuits 312 and 502 operating in their pumped refrigerant economization cooling modes are needed to provide cooling. Controller 326' is configured to operate cooling system 500 in Mode 1.2 when cooling demand due to heat load is low enough that only one of cooling circuits 312, 502 operating in its pumped refrigerant economization mode is needed to provide cooling, illustratively, operating cooling circuit 312 in its pumped refrigerant economization mode. When operating cooling system 500 in Mode 1.1, controller 326' is configured to operate both cooling circuits 312 and 502 in their pumped refrigerant economization cooling modes. When operating cooling system 500 in Mode 1.2, controller 326' is configured to operate cooling circuit 312 in its pumped refrigerant economization cooling mode and have cooling circuit 502 off.

Controller 326' is configured to operate cooling system 500 in the second mode of operation (Mode 2 in Table 2 shown in FIG. 6B) when the outdoor temperature is at a medium temperature which as used herein is a temperature in a range of temperatures that are low enough that pumped refrigerant economization cooling can provide some cooling but is not low enough that pumped refrigerant economization cooling can provide enough cooling to satisfy the cooling demand. It should be understood that the low and medium temperatures ranges can overlap, as shown in FIG. 6, with the difference between whether the cooling system 500 is operating in the first mode or second mode being the cooling demand that cooling system 500 is being called upon to satisfy due to heat load. If a particular outdoor temperature is low enough that pumped refrigerant economization can provide enough cooling to satisfy the cooling demand, then the cooling system 500 operates in the first mode. If that particular outdoor temperature is not low enough that pumped refrigerant economization cannot provide enough cooling to satisfy all the cooling demand but low enough that pumped refrigerant economization can provide some of the cooling, the cooling system 500 operates in the second mode.

In the second mode of operation, cooling system 500 has three sub-modes of operation. In the first sub-mode of operation of Mode 2 (Mode 2.1 in FIG. 6A and Table 2 shown in FIG. 6B), controller 326' is configured to operate pumped refrigerant economization circuit 312 at 100% capacity, operate cooling circuit 502 in the pumped refrigerant economization cooling mode at 100% capacity with liquid pump 514 on with bypass valve 516 closed, compressor 506 off with bypass valve 507 open, and configured to operate DX cooling circuit 302 at a capacity (0-100%) that provides cooling to supplement the cooling provided by the pumped refrigerant economization cooling so that the pumped refrigerant economization cooling provided by pumped refrigerant economization circuit 312 and cooling circuit 502 operating in the pumped refrigerant economization cooling mode and the DX cooling provided by DX cooling circuit 302 provide enough cooling to satisfy the cooling demand. In Mode 2.1, controller 326' is configured to control condenser fan 320 to compressor cycle condensing pressure of compressor 310.

When cooling demand due to heat load decreases to the point where cooling circuit 502 is no longer needed to provide cooling, operation transitions to the second sub-mode of operation of Mode 2 (Mode 2.2 in FIG. 6A and Table 2 shown in FIG. 6B). In Mode 2.2, controller 326' is configured to operate pumped refrigerant economization circuit 312 at 100% capacity, have cooling circuit 502 off (compressor 506 and liquid pump 514 both off) and operate DX cooling circuit 302 at a capacity (0-100%) that provides cooling to supplement the cooling provided by the pumped refrigerant economization cooling so that the pumped refrigerant economization cooling provided by pumped refrigerant economization circuit 312 and the DX cooling provided by DX cooling circuit 302 provide enough cooling to satisfy the cooling demand. In Mode 2.2, controller 326' is configured to control condenser fan 320 to compressor cycle condensing pressure of compressor 310.

When cooling demand due to heat load increases to the point where operating cooling system 500 in Modes 2.1 or 2.2 cannot provide enough cooling to satisfy the cooling demand, operation transitions to the third sub-mode of operation of Mode 2 (Mode 2.3 in FIG. 6A and Table 2 shown in FIG. 6B). In Mode 2.3, controller 326' is configured to operate pumped refrigerant economization circuit 312 at 100% capacity and operate cooling circuit 502 in the DX cooling mode (compressor 506 on with bypass valve 507 closed and liquid pump 514 off with bypass valve 516 open) and operate DX cooling circuit 302 to provide cooling. In Mode 2.3, controller 326' is also configured to operate cooling circuits 302 and 502 to provide cooling supplementing the cooling provided by the pumped refrigerant economization cooling so that the pumped refrigerant economization cooling provided by pumped refrigerant economization circuit 312 and the DX cooling provided by DX cooling circuit 302 and cooling circuit 502 operating in the DX cooling mode provide enough cooling to satisfy the cooling demand. In this regard, in an aspect, controller 326' is configured in an aspect to operate cooling circuit 302 at 100% capacity and to operate cooling circuit 502 at a capacity (0-100%) to provide any additional supplemental cooling that is needed. In an aspect, controller 326' is configured to operate cooling circuit 502 at 100% capacity and to operate cooling circuit 302 at a capacity (0-100%) to provide any additional supplemental cooling that is needed. In an aspect, controller 326' is configured to operate cooling circuits 302, 502 at a collective capacity (0-100%) to provide the supplemental cooling that is needed and that in an aspect, to operate cooling circuits 302, 502 at the same capacity. In Mode 2.3, controller 326' is configured to control condenser fan 320 to compressor cycle condensing pressure of compressor 310 and to control condenser fan 511 to compressor condensing pressure of compressor 506.

Controller 326' is configured to operate cooling system 500 in the third mode of operation (Mode 3 in Table 2 shown in FIG. 6B) when the outdoor temperature is at a high temperature which as used herein is a temperature that is at or above a temperature that is high enough that pumped refrigerant economization cooling cannot effectively provide any cooling. In the third mode of operation, controller 326' is configured to operate cooling circuit 502 in the DX cooling mode (compressor 506 running with bypass valve 507 closed) and to operate DX cooling circuit 302 to provide cooling (compressor 310 running) and to operate cooling circuits 302, 502 at a capacity (0-100%) that provides enough cooling to satisfy the cooling demand. In Mode 3, controller 326' is configured to control condenser fan 320 to compressor cycle condensing pressure (of compressor 310) and to control condenser fan 511 to compressor cycle condensing pressure (of compressor 506). In Mode 3, controller 326' is configured so that it does not operate pumped refrigerant economization circuit 312 to provide cooling, that is, it has pump 316 off, and is also configured to have liquid pump 514 of cooling circuit 502 off with bypass valve 516 open. In Mode 3, controller 326' is configured to control condenser fan 320 to compressor cycle condensing pressure of compressor 310 and to control condenser fan 511 to compressor cycle condensing pressure of compressor 506.

In an aspect, in Mode 3 cooling system 500 has two sub-modes of operation (Modes 3.1 and 3.2 in FIG. 6A and Table 2 shown in FIG. 6B). Controller 326' is configured to operate cooling system 500 in Mode 3.1 when cooling demand due to heat load is such that cooling circuits 302 and 502 both need to operate in their DX cooling mode to provide enough cooling satisfy the cooling demand. When operating cooling system 500 in Mode 3.1, controller 326' is configured to operate cooling circuit 302 in its DX cooling mode, operate cooling circuit 502 in its DX cooling mode and have cooling circuit 312 off. Controller 326' is configured to operate cooling system 500 in Mode 3.2 when the cooling demand due to heat load is such that cooling circuit 302 can provide enough cooling to satisfy the cooling demand and the temperature of outside air is not low enough that cooling circuit 502 can provide cooling when operating in its pumped refrigerant economization cooling mode. When operating cooling system 500 in Mode 3.2, controller 326' is configured to operate cooling circuit 302 in its DX cooling mode, have cooling circuit 312 off and have cooling circuit 502 off.

It should be understood that the temperatures that controller 326' uses in determining the mode in which to operate cooling system 500 as discussed above can be determined heuristically or mathematically and programmed in controller 326'.

Figure 7:
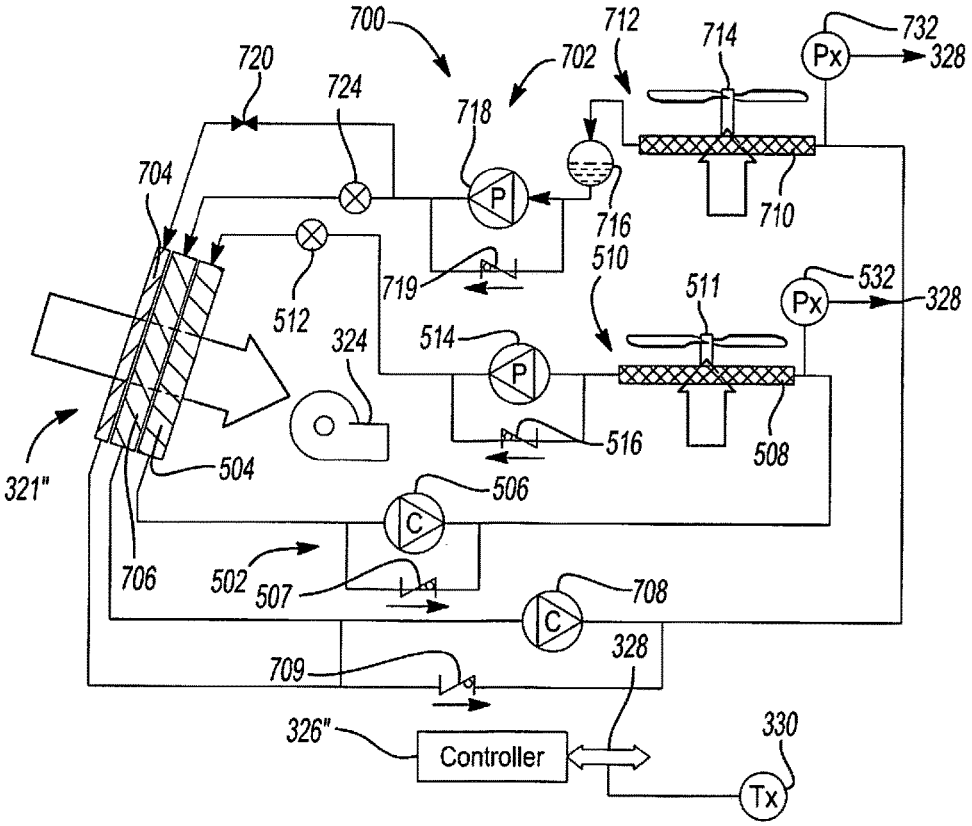
FIG. 7 is a simplified schematic of a cooling system having two cooling circuit with each having pumped refrigerant economization cooling and DX cooling and one of the cooling circuit having an additional evaporator coil used when the cooling circuit is operating in the pumped refrigerant economization cooling mode.

With reference to FIG. 7, a cooling system 700 in accordance with an aspect of the present disclosure is shown that is a variation of cooling system 300 of FIG. 3 and of cooling system 500 of FIG. 5. Cooling system 500 also includes DX cooling and pumped refrigerant economization cooling. Cooling system 700 includes cooling circuit 502 that has both pumped refrigerant economization and DX cooling as discussed above and a cooling circuit 702 that also has both pumped refrigerant economization and DX cooling. Cooling circuits 502, 702 are separate cooling circuits. Cooling circuit 702 includes a microchannel evaporator coil 704 and a fin-and tube evaporator coil 706. It should be understood that evaporator coil 706 could alternatively be a microchannel cooling coil or other type of fluid-to-fluid heat exchanger. Outlets of evaporator coils 704, 706 are coupled to an inlet of a compressor 708. An outlet of compressor 708 is coupled to an inlet of a condenser coil 710 of a condenser 712 that also includes a condenser fan 714. A bypass valve 709 is coupled around compressor 708 between the inlet and outlet of compressor 708. Bypass valve 709 is shown in the embodiment of FIG. 7 as a check valve, but it should be understood that it could be other types of valves, such as a solenoid valve. Bypass valve 709 is open when compressor 708 is off and closed when compressor 708 is running. Condenser coil 710 is illustratively a microchannel cooling coil although it should be understood that it could alternatively be a fin-and-tube cooling coil or other type of fluid-to-fluid heat exchanger.

An outlet of condenser coil 710 is coupled to an inlet of a receiver tank 716 and an outlet of receiver tank 716 is coupled to an inlet of a liquid pump 718. A bypass valve 719 is coupled around liquid pump 718 between the inlet of liquid pump 718 and an outlet of liquid pump 718. Bypass valve 719 is a check valve in the embodiment of FIG. 7 but could be other types of valves such as a solenoid valve. Bypass valve 719 is closed when liquid pump 718 is running and open when liquid pump 718 is off. The outlet of liquid pump 718 is coupled through solenoid valve 720 to an inlet of evaporator coil 704 and also through an expansion device 724 to an inlet of evaporator coil 706. Evaporator 321" of cooling system 700 includes evaporator coils 704, 706 and 504 stacked together in series so that air to be cooled passes across them in serial fashion, first across evaporator coil 704, then across evaporator coil 706 and then across evaporator coil 504. Evaporator coils 704, 706 are both part of cooling circuit 702 and in the context of cooling system 700, may be referred to collectively as upstream evaporator coils 704, 706 of cooling system 700. In the context of cooling circuit 702, evaporator coil 704 is an upstream evaporator coil and may be referred to as upstream evaporator coil 704 of cooling circuit 702 and evaporator coil 706 is a downstream evaporator coil and may be referred to as downstream evaporator coil 706 of cooling circuit 702. In the context of cooling system 700, evaporator coil 504 is a downstream evaporator coil and may be referred to as downstream evaporator coil 504 of cooling system 700. Expansion device 724 may preferably be an electronic expansion valve but could be other types of expansion devices.

Cooling system 700 also includes a controller 326" that is configured to control cooling system 700 including cooling circuits 502, 702. Controller 326" includes inputs/outputs 328 coupled to the various components of cooling circuits 502, 702 and to various sensors, such as an outdoor temperature sensor 330 and condenser coil pressure sensors 532, 732.

Figure 8A:
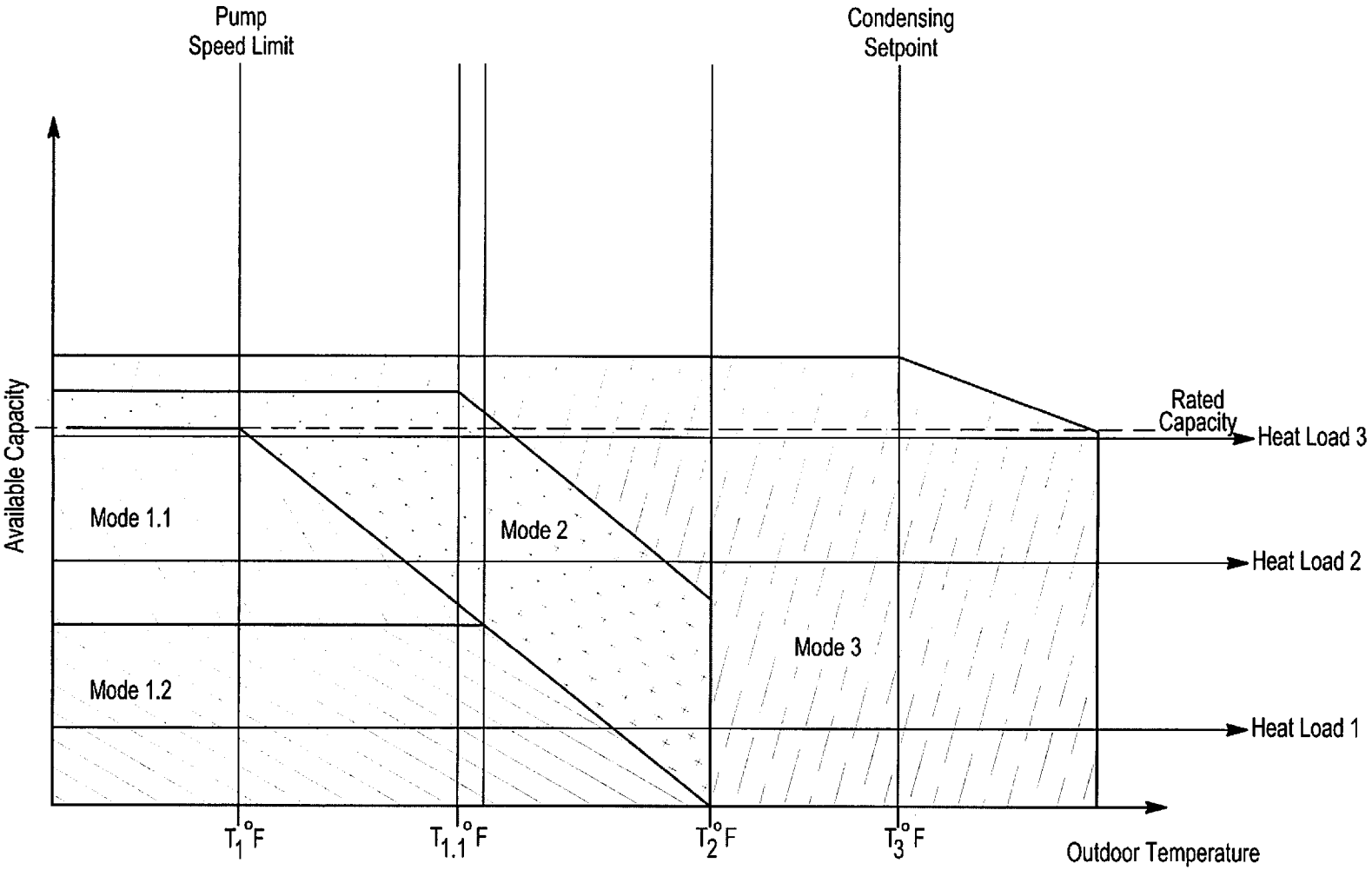
FIG. 8A is a state chart showing the operation of the cooling system of FIG. 7

FIG. 8A is a state chart showing the modes of operation of cooling system 700 and Table 3 shown in FIG. 8B is a state table showing the modes of operation of cooling system 700. Cooling system 700 has the same three basic modes of operation as cooling systems 300, 500: (1) where only pumped refrigerant economization is used to provide cooling; (2) where both pumped refrigerant economization and DX cooling are used to provide cooling; and (3) where only DX cooling is used to provide cooling. Cooling system 700 also has two sub-modes of operation when operating in Mode 1, as discussed below. As can be seen in FIG. 6A by the various Heat Load lines, for any given heat load, cooling system 500 will change among its modes of operation depending on outdoor air temperature, as discussed in more detail below.

With reference to FIG. 8A and Table 3 shown in FIG. 8B, controller 326" is configured to operate cooling system 700 in the first mode of operation (Mode 1) where only pumped refrigerant economization is used to provide cooling when the outdoor temperature is at a low temperature range which as used herein is a temperature that is at or lower than a temperature that is low enough that pumped refrigerant economization cooling can provide enough cooling to satisfy the cooling demand. In Mode 1, controller 326" is configured to control cooling circuit 702 to operate in a pumped refrigerant economization cooling mode with liquid pump 718 on (with bypass valve 719 closed) and compressor 708 off (with bypass valve 709 open). In Mode 1, controller is configured to control solenoid valve 720 to be open and also to control expansion device 724 based on pump head pressure so that it is mostly open and acting as a pressure regulating valve to pass refrigerant through and not acting as an expansion device. In Mode 1, controller 326" is also configured to operate cooling circuit 502 in a pumped refrigerant economization cooling mode with liquid pump 514 on (with bypass valve 516 closed) and compressor 506 off (with bypass valve 507 open) at a capacity between 0%-100% to provide any supplemental cooling to the cooling provided by cooling circuit 702 if supplemental cooling is needed. When operating cooling circuit 502 in the pumped refrigerant economization cooling mode, controller 326" is also configured to control expansion device 512 to be open based on pump head pressure so that it is acting as a pressure regulating valve to pass refrigerant through and not acting as an expansion device. By having solenoid valve 720 open during this mode of operation when cooling circuit 702 is operating in the pumped refrigerant economization cooling mode, more evaporating coil (the combination of evaporator coils 704, 706) is provided which increases the superheat region when liquid pump 718 is running and this helps improve superheat control when in transition from pumped refrigerant economization cooling mode to DX cooling mode. In this regard, when cooling circuit 702 is operating in the pumped refrigerant economization cooling mode, refrigerant is pumped by liquid pump 718 through both evaporator coils 704, 706.

In an aspect, in the first mode of operation cooling system 700 has two sub-modes of operation, Modes 1.1 and 1.2 in FIG. 8A and Table 3 (FIG. 8B). Controller 326" is configured to operate cooling system 700 in Mode 1.1 when the cooling demand due to heat load is high enough that both cooling circuits 312 and 502 operating in their pumped refrigerant economization cooling modes are needed to provide cooling. Controller 326' is configured to operate cooling system 500 in Mode 1.2 when cooling demand due to heat load is low enough that only one of cooling circuits 502, 702 operating in its pumped refrigerant economization mode is needed to provide cooling, illustratively, operating cooling circuit 312 in its pumped refrigerant economization mode. When operating cooling system 700 in Mode 1.1, controller 326" is configured to operate both cooling circuits 502, 702 in their pumped refrigerant economization cooling modes. When operating cooling system 700 in Mode 1.2, controller 326" is configured to operate cooling circuit 702 in its pumped refrigerant economization cooling mode and have cooling circuit 502 off.

Figure 11:
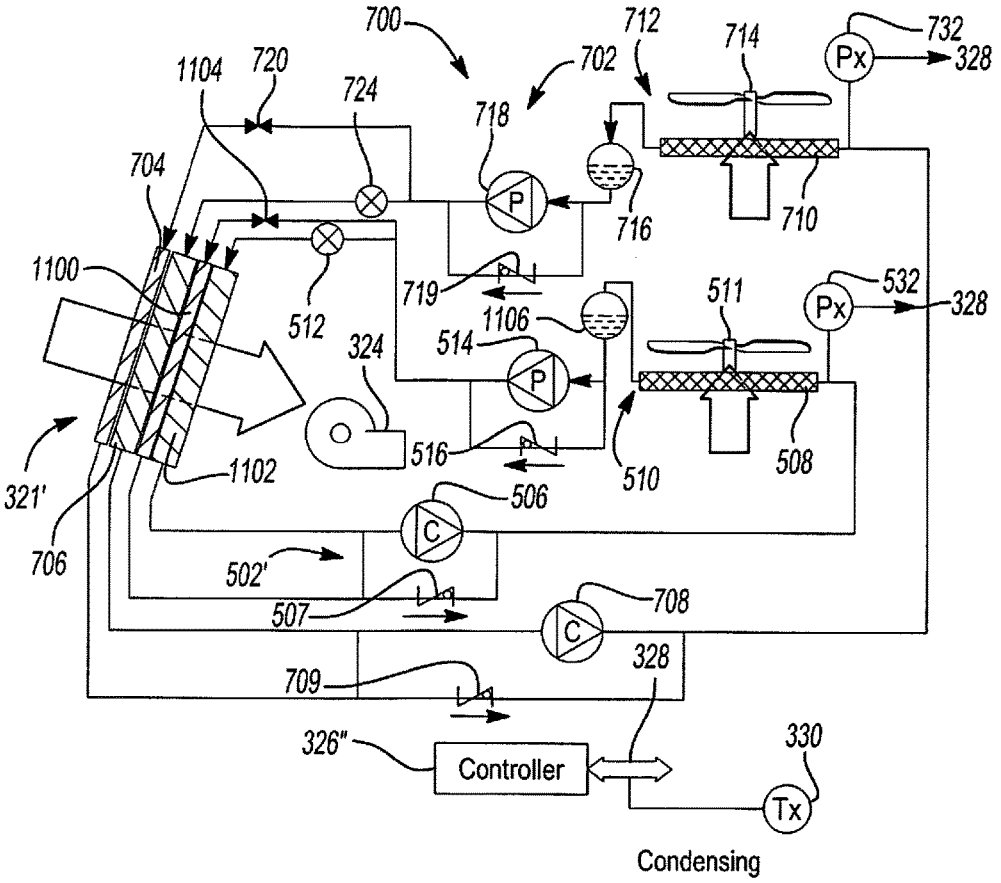
FIG. 11 is a simplified schematic showing a variation of the cooling system of FIG. 7.

It should be understood that cooling circuit 502 could alternatively or additionally have the added evaporator coil that evaporator coil 704 provides to cooling circuit 702 and cooling circuit 502 then would also have a flow topology with a solenoid valve comparable to solenoid valve 720 and a receiver comparable to receiver 716. FIG. 11 shows such a topology for cooling circuit 502 with the added evaporator coil, referred to as cooling circuit 502' and having upstream evaporator coil 1100, downstream evaporator coil 1102 and controlled valve 1104.

Controller 326" is configured to operate cooling system 700 in the second mode of operation (Mode 2 in Table 3 shown in FIG. 8B) when the outdoor temperature is at a medium temperature which as used herein is a temperature in a range of temperatures that are low enough that pumped refrigerant economization cooling can provide some cooling but is not low enough that pumped refrigerant economization cooling can provide enough cooling to satisfy the cooling demand. It should be understood that the low and medium temperatures ranges can overlap, as shown in FIG. 8A, with the difference between whether the cooling system 700 is operating in the first mode or second mode being the cooling demand that cooling system 700 is being called on to satisfy. If a particular outdoor temperature is low enough that pumped refrigerant economization can provide enough cooling to satisfy all the cooling demand, then the cooling system 700 operates in the first mode. If that particular outdoor temperature is not low enough that pumped refrigerant economization cannot provide enough cooling to satisfy all the cooling demand but low enough that pumped refrigerant economization can provide some of the cooling, the cooling system 700 operates in the second mode.

In Mode 2, controller 326" is configured to operate cooling circuit 702 in the pumped refrigerant economization cooling mode at 100% capacity and operate cooling circuit 502 in the DX cooling mode (compressor 506 on with bypass valve 507 closed and liquid pump 514 off with bypass valve 516 open) at a capacity (0%-100%) that provides cooling to supplement the cooling provided by the pumped refrigerant economization cooling so that the pumped refrigerant economization cooling provided by cooling circuit 702 and the DX cooling provided by cooling circuit 502 operating in the DX cooling mode provide enough cooling to satisfy the cooling demand. In the second mode of operation, controller 326" is configured to control solenoid valve 720 to be open and also to control expansion device 724 based on pump head pressure to be mostly open so that is acting as a pressure regulating valve to pass refrigerant through and not acting as an expansion valve. In the second mode of operation, controller 326" is configured to control condenser fan 511 to compressor cycle condensing pressure of compressor 506.

Controller 326" is configured to operate cooling system 700 in the third mode of operation (Mode 3 in Table 3 shown in FIG. 8B) when the outdoor temperature is at a high temperature which as used herein is a temperature that is at or above a temperature that is high enough that pumped refrigerant economization cooling cannot effectively provide any cooling. In Mode 3, controller 326" is configured to operate cooling circuits 502 and 702 in the DX cooling mode and to operate them at a capacity (0-100%) provide enough cooling to satisfy the cooling demand. In the third mode of operation, controller 326" is configured to control compressor 708 to be running (with bypass valve 709 closed), liquid pump 718 to be off (with bypass valve 719 open), solenoid valve 720 to be closed and expansion device 724 to operate as an expansion device. In Mode 3, controller 326" is also configured to control compressor 506 to be running (with bypass valve 507 closed) and expansion device 512 to operate as an expansion device. In Mode 3, controller 326" is configured to control condenser fan 511 to compressor cycle condensing pressure of compressor 506 and to control condenser fan 714 to compressor cycle condensing pressure of compressor 708. It should be understood that an electronic expansion valve could alternatively be used instead of solenoid valve 720 between the outlet of liquid pump 718 and the inlet of evaporator coil 704 and evaporator coil 704 could then also be used when cooling circuit 702 is operating in the DX cooling mode. In this variation, controller 326" is configured to control the expansion valve used instead of solenoid valve 720 to be mostly open and act as a pressure regulating valve.

It should be understood that although the embodiment of FIG. 3 has only one pumped refrigerant economization circuit, it should be understood that multiple pumped refrigerant economization circuits could be integrated together from different units by adding a receiver tank and sharing the refrigerant pump. In other words, one condenser coil could feed multiple pumped refrigerant economization circuits as shown in FIG. 9 or multiple condenser coils could feed one pumped refrigerant economization circuit as shown in FIG. 10.

Figure 9:
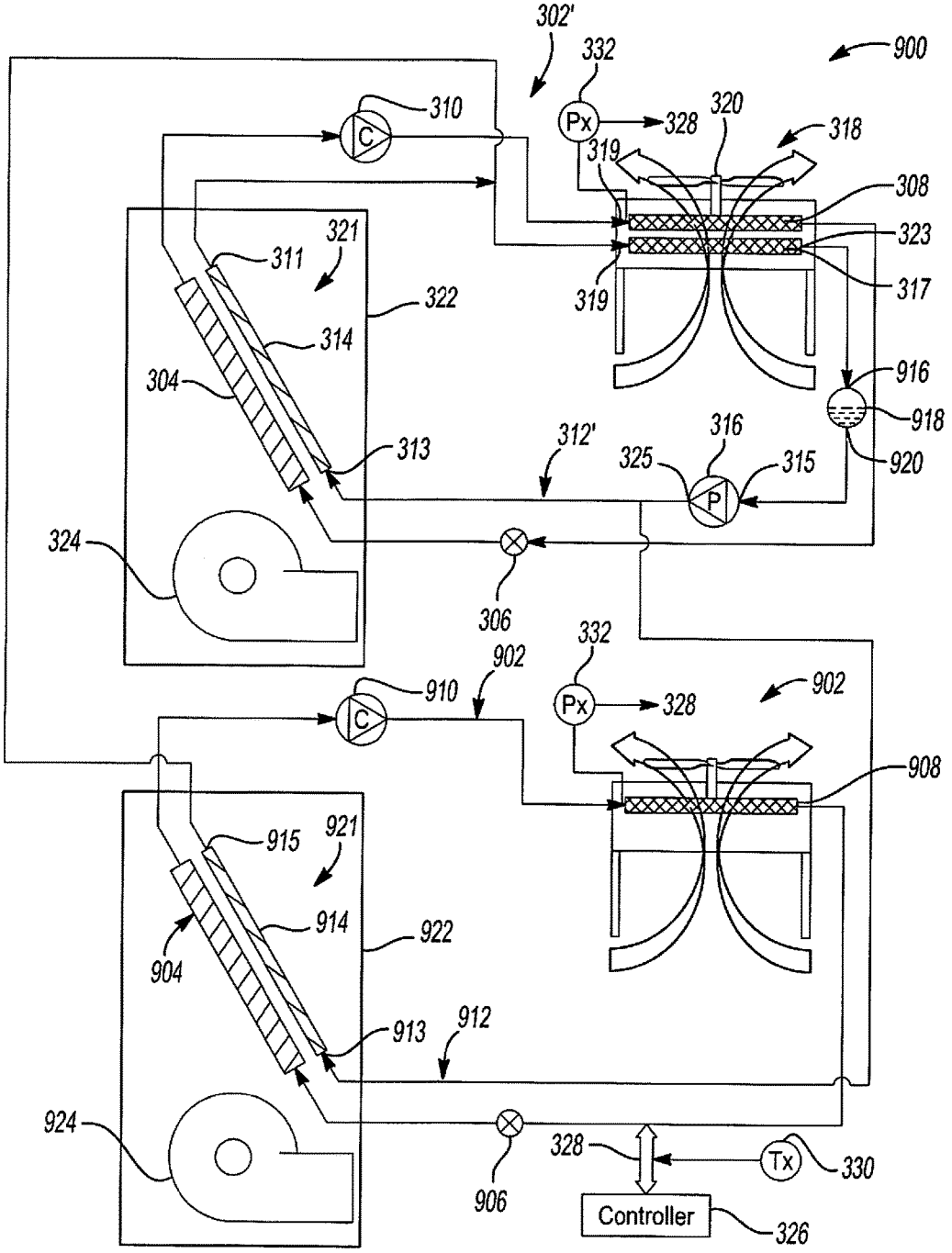
FIG. 9 is a simplified schematic showing a variation of the cooling system of FIG. 3.

With reference to FIG. 9, a cooling system 900 has a DX cooling circuit 302' and pumped refrigerant economization circuit 312' that with the differences described below, are otherwise the same as DX cooling circuit 302 and pumped refrigerant economization cooling circuit 312 of FIG. 3. In cooling system 900, condenser coil 317 of condenser 318 feeds multiple pumped refrigerant economization circuits as described below. Cooling system 900 also has a second DX cooling circuit 902 having an evaporator coil 904, compressor 910, condenser coil 908 and an expansion device 906 (which may preferably be an electronic expansion valve but may also be a thermostatic expansion valve or other type of expansion device) arranged in a DX refrigeration circuit. Cooling system 900 also includes a second pumped refrigerant economization cooling circuit 912 having an evaporator coil 914 that is arranged with liquid pump 316 of pumped refrigerant economization circuit 312' in the second pumped refrigerant economization cooling circuit 912. In this regard, liquid pump 316 and condenser coil 317 are shared with pumped refrigerant economization circuit 312' and pumped refrigerant economization circuit 912. An outlet 325 of liquid pump 316 is coupled to an inlet 913 of evaporator coil 914 in addition to an inlet 313 of evaporator coil 314 and an outlet 915 of evaporator coil 914 is coupled to an inlet 319 of condenser coil 317. An inlet 916 of a receiver tank 918 is coupled to an outlet 323 of condenser coil 317 and an outlet 920 of receiver tank 918 is coupled to an inlet 315 of liquid pump 316. Cooling system 900 includes a second evaporator 921 arranged in a cabinet 922 that includes evaporator coils 904, 914 and air moving unit 924, such as a squirrel cage blower.

Figure 10:
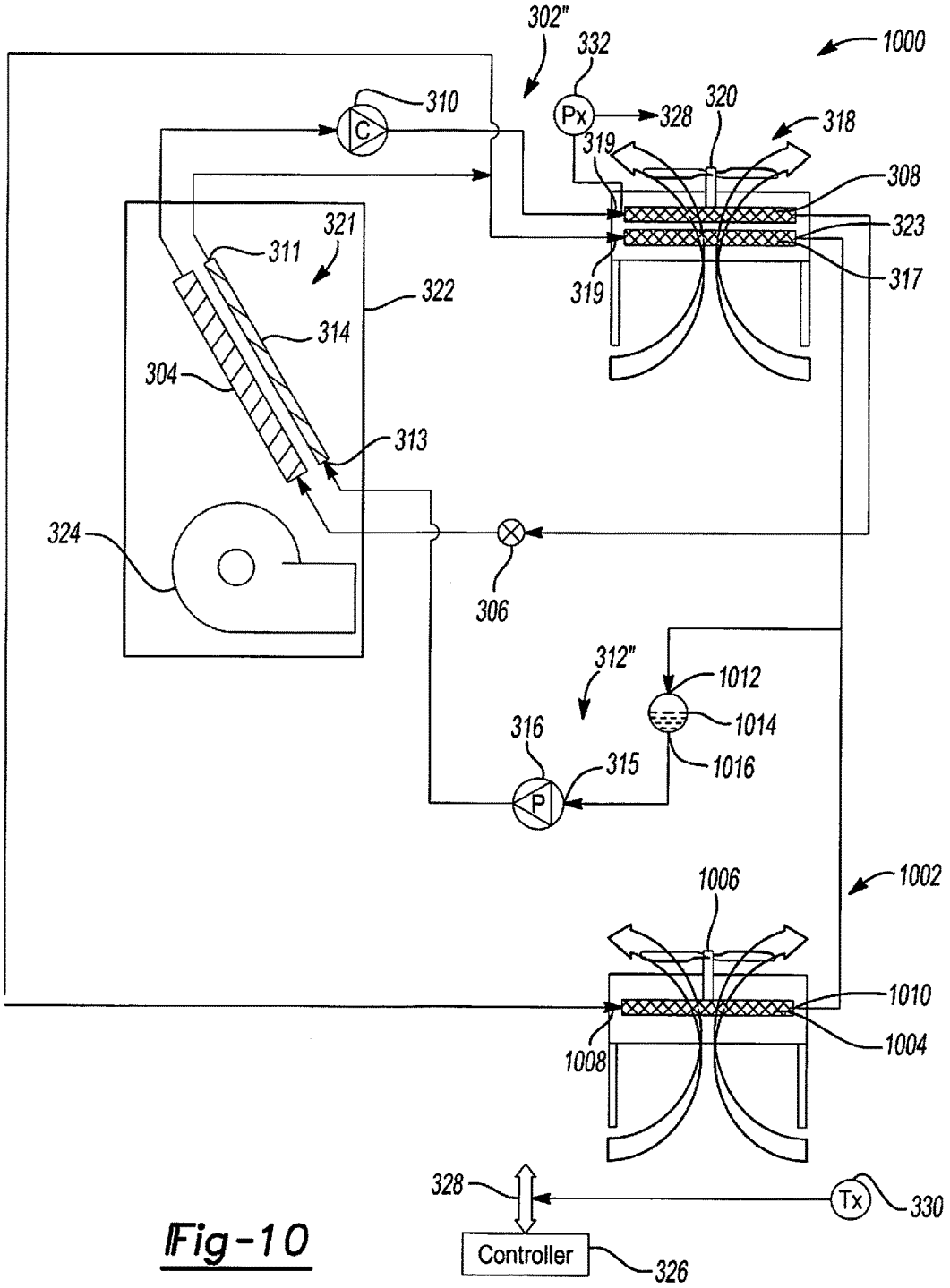
FIG. 10 is a simplified schematic showing another variation of the cooling system of FIG. 3.

With reference to FIG. 10, a cooling system 1000 has a DX cooling circuit 302" and pumped refrigerant economization cooling circuit 312" that with the differences described below, are otherwise the same as DX cooling circuit 302 and pumped refrigerant economization cooling circuit 312 of FIG. 3. In cooling system 1000, multiple condenser coils feed pumped refrigerant economization circuit 312" as described below. Cooling system 1000 includes a second condenser 1002 having a condenser coil 1004 and a condenser fan 1006 that draws cooling air across condenser coil 1004. An inlet 1008 of condenser coil 1004 is coupled to an outlet 311 of evaporator coil 314. Outlet 311 of evaporator coil 314 is also coupled to an inlet 319 of condenser coil 317 of condenser 318. An outlet 1010 of condenser coil 1004 and an outlet 323 of condenser coil 317 are both coupled to an inlet 1012 of a receiver tank 1014 and an outlet 1016 of receiver tank 1014 is coupled to an inlet 315 of pump 316.

As used herein, the term controller, control module, control system, or the like may refer to, be part of, or include an Application Specific Integrated Circuit (ASIC); an electronic circuit; a combinational logic circuit; a field programmable gate array (FPGA); a processor (shared, dedicated, or group) that executes code; a programmable logic controller, programmable control system such as a processor based control system including a computer based control system, a process controller such as a PID controller, or other suitable hardware components that provide the described functionality or provide the above functionality when programmed with software as described herein; or a combination of some or all of the above, such as in a system-on-chip. The term module may include memory (shared, dedicated, or group) that stores code executed by the processor. When it is stated that such a device performs a function, operate another device or has another device in a specified state, it should be understood that the device is configured to perform the function, control the operation of the other device or control the other device to be in the specified state by appropriate logic, such as software, hardware, or a combination thereof.

The term software, as used above, may refer to computer programs, routines, functions, classes, and/or objects and may include firmware, and/or microcode.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A cooling system, comprising:

a cabinet having an air inlet and an air outlet;

an air moving unit disposed in the cabinet;

first and second cooling circuits;

a controller configured to operate the cooling system including the cooling circuits;

the first cooling circuit having an upstream evaporator coil and a downstream evaporator coil, a first condenser, a first compressor, a receiver tank, a first liquid pump, a first liquid pump bypass valve that bypasses the liquid pump when the liquid pump bypass valve is open, a first compressor bypass valve that bypasses the first compressor when the first compressor bypass valve is open, a first controlled valve coupled between the first liquid pump and the first upstream evaporator coil and a first expansion device coupled between the first liquid pump bypass valve and the first downstream evaporator coil;

the second cooling circuit having an second evaporator coil, a second condenser, a second compressor, and a second liquid pump, a second liquid pump bypass valve that bypasses the second liquid pump when the second liquid pump bypass valve is open, a second compressor bypass valve that bypasses the second compressor when the second compressor bypass valve is open, and a second expansion device coupled between the second liquid pump bypass valve and the downstream evaporator coil;

an evaporator disposed in the cabinet that includes the first upstream evaporator coil and the first downstream evaporator coil of the first cooling circuit and the second evaporator coil of the second cooling circuit;

the first upstream and first downstream evaporator coils of the first cooling circuit are arranged so that air to be cooled passes across them in serial fashion, first over the first upstream evaporator coil of the first cooling circuit and then over the first downstream evaporator coil of the first cooling circuit;

the second evaporator coil of the second cooling circuit arranged so that the air to be cooled passes over it and over the first upstream and first downstream evaporator coils of the first cooling circuit in serial fashion;

the first and second cooling circuits each having a pumped refrigerant economization cooling mode and a direct expansion cooling mode wherein when any of the first and second cooling circuits are operated by the controller in direct expansion cooling mode the controller is configured to have the compressor of that cooling circuit on with the compressor bypass valve of that cooling circuit closed and the liquid pump of that cooling circuit off and bypassed with the liquid pump bypass valve of that cooling circuit open and when that cooling circuit is operated by the controller in the pumped refrigerant economization cooling mode the controller is configured to have compressor of that cooling circuit off and bypassed with the compressor bypass valve of that cooling circuit open and the liquid pump of that cooling circuit on with the liquid pump bypass valve of that cooling circuit closed; and wherein when the first cooling circuit is operated by the controller in its pumped refrigerant economization cooling mode the controller is configured to have the first controlled valve coupling the first liquid pump to the first upstream evaporator coil open and refrigerant flows from the first liquid pump through the open first controlled valve to the first upstream evaporator coil and also flows from the first liquid pump to the first downstream evaporator coil through the first expansion device and when the first cooling circuit is operated by the controller in its direct expansion cooling mode the controller is configured to have the first controlled valve closed and refrigerant flows around the bypassed first liquid pump of the first refrigerant circuit and only to the first downstream evaporator coil through the first expansion device and not to the first upstream evaporator coil.

2. The cooling system of claim 1 having first, second and third modes of operation and the controller is configured to operate the cooling system in its first, second and third modes of operation wherein the controller is configured to operate the cooling circuits:

in the first mode of operation so that only pumped refrigerant economization cooling is used to provide cooling;

in the second mode of operation so that both pumped refrigerant economization cooling and direct expansion cooling are used to provide cooling, and in the third mode of operation so that only direct expansion cooling is used to provide cooling.

3. The cooling system of claim 2 wherein when the cooling system is operating in its first mode of operation the controller is configured to operate the first cooling circuit in its pumped refrigerant economization cooling mode and configured to operate the second cooling circuit in its pumped refrigerant economization cooling mode to provide any supplemental cooling that is needed when temperature of outside air is low enough that the second cooling circuit is operable to provide cooling when operating in its pumped refrigerant economization cooling mode.

4. The cooling system of claim 2 wherein when the cooling system is operating in its second mode of operation, the controller is configured to operate the first cooling circuit in its pumped refrigerant economization cooling mode at full capacity and configured to operate the second cooling circuit in its direct expansion cooling mode at a capacity to provide any supplemental cooling that is needed.

5. The cooling system of claim 2 wherein when the cooling system is operating in its third mode of operation, the controller is configured to operate the first and second cooling circuits in their direct expansion cooling modes.

6. The cooling system of claim 2 wherein the controller is configured to:

operate the cooling system in its first mode of operation when a temperature of outside air is low enough that pumped refrigerant economization can provide enough cooling to satisfy cooling demand;

operate the cooling system in its second mode of operation when the temperature of outside air is low enough that pumped refrigerant economization can provide cooling to satisfy only some of the cooling demand; and operate the cooling system in its third mode of operation when the temperature of outside air is high enough that pumped refrigerant economization cannot provide cooling.

7. The cooling system of claim 1 wherein the first upstream evaporator coil is a microchannel coil and the first downstream evaporator coil is a fin and tube coil.

8. The cooling system of claim 1, wherein the second cooling circuit including another evaporator coil wherein the second evaporator coil of the second cooling circuit is a second upstream evaporator coil and the other of the evaporator coils of the second cooling circuit is a second downstream evaporator coil and when the second cooling circuit is operated by the controller in its pumped refrigerant economization cooling mode the controller is configured to have a second controlled valve of the second cooling circuit coupling the liquid pump of the second cooling circuit to the second upstream evaporator coil of the second cooling circuit open and refrigerant flows from the second liquid pump of the second cooling circuit through the second open controlled valve of the second cooling circuit to the second upstream evaporator coil of the second cooling circuit and also flows from the second liquid pump of the second evaporator circuit to the second downstream evaporator coil of the second cooling circuit through the second expansion device of the second cooling circuit and when the second cooling circuit is operated by the controller in its direct expansion cooling mode the controller is configured to have the second controlled valve of the second cooling circuit closed and refrigerant flows around the bypassed second liquid pump of the second refrigerant circuit and only to the second downstream evaporator coil of the second cooling circuit through the second expansion device of the second cooling circuit and not to the second upstream evaporator coil of the second cooling circuit.

* * * * *